United States Patent [19]

Moll

[11] Patent Number: 4,865,578

[45] Date of Patent: Sep. 12, 1989

[54] GLUE HEAD MOUNTING BRACKET FOR GLUE APPLYING FOLDING MACHINES

[76] Inventor: Richard J. Moll, c/o Dick Moll & Sons, Warminster, Pa. 18974

[21] Appl. No.: 194,217

[22] Filed: May 16, 1988

[51] Int. Cl.[4] ..... B05C 1/00

[52] U.S. Cl. ..... 493/331; 493/333; 493/336; 493/420; 118/222; 118/681

[58] Field of Search ..... 493/331, 333, 336, 420, 493/421; 427/286; 118/221, 222, 248, 681

[56] References Cited

U.S. PATENT DOCUMENTS

| | | | |
|---|---|---|---|
| 302,519 | 7/1884 | Parsons . | |
| 574,547 | 1/1897 | Lewis . | |
| 1,186,885 | 6/1916 | Cook . | |
| 1,211,865 | 1/1917 | McIntire . | |
| 2,800,418 | 7/1952 | Cannon | 427/286 |
| 3,088,433 | 5/1963 | Walter et al. | 118/681 |
| 3,142,470 | 7/1964 | Iandiorio . | |
| 3,727,576 | 4/1973 | Schriber | 118/221 |
| 3,915,115 | 10/1975 | Bramleg et al. | 118/681 |
| 4,243,342 | 1/1981 | Marto . | |
| 4,244,319 | 1/1981 | Carstedt | 118/681 |
| 4,650,454 | 3/1987 | Moll | 493/420 |

*Primary Examiner*—Frederick R. Schmidt
*Assistant Examiner*—Robert Showalter
*Attorney, Agent, or Firm*—Z. T. Wobensmith, III

[57] ABSTRACT

A glue head mounting bracket for glue applying folding machines is disclosed which holds a glue head for dispensing glue onto a sheet of paper that is to be folded and secured at the glue lines, which bracket permits the glue head to be placed at a predetermined location and the glue head swiveled out of the way for non-glue application. The bracket is of two piece fixed and demountable construction with the glue head carried in the demountable bracket piece, so that the glue head can be moved for cleaning and repair or replacement, and the glue head placed back into service without changing the location of the glue line.

2 Claims, 3 Drawing Sheets

FIG. 2
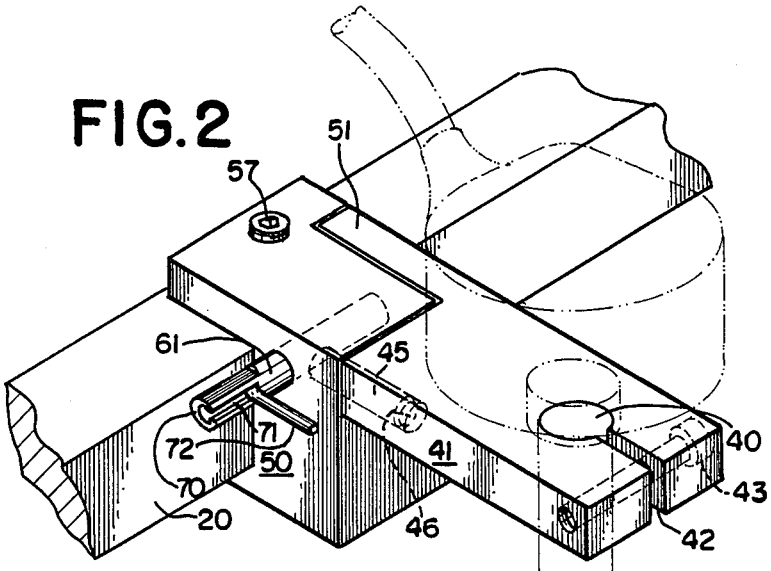
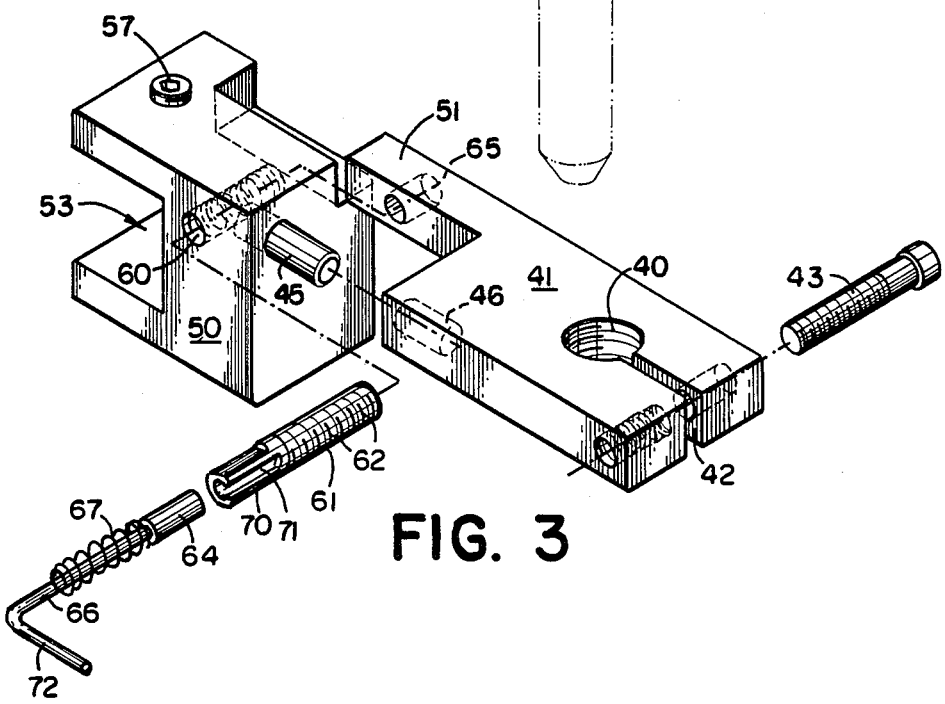
FIG. 3

GLUE HEAD MOUNTING BRACKET FOR GLUE APPLYING FOLDING MACHINES

BACKGROUND OF THE INVENTION

1. Field of the Invention

This invention relates to brackets for mounting glue heads on folding machines, and more particularly to a bracket which permits detachment or swiveling of the glue head to an out of use position and return to service while maintaining the original glue line location.

2. Description of the Prior Art

Glue applying folding machines are used when one or more lines of glue are to be applied to sheets of paper, which sheets are then folded and bound in the folding machine.

The common practice in the folding machine industry is to bolt the glue heads directly to a transverse bar above the paper. The glue heads are susceptible to clogging when not in constant use, and must be removed for cleaning which requires disturbing the location setting on the folding machine, often resulting in products of inconsistent quality. It may be necessary when running different jobs or with multiple glue line applications, for one or more of the glue heads to be moved out of contact with the sheets of paper when running the job, which requires removal of the entire glue head assembly and consequently reassembly and setting when the glue line is to be resumed.

Various brackets have been proposed for use with equipment in applications other than glue head mounting for folding machines. Examples of prior art mounting brackets are shown in the U.S. Patents to Parsons No. 302,519; Lewis No. 574,547; Cook No. 1,186,885; McIntire No. 1,211,865; A. Iandiorio et al. No. 3,142,470; and Marto No. 4,243,342.

My prior patent No. 4,650,554 discloses glue heads in a folding machine mounted to a transversely extending bar 14 by mounting blocks 16 and thumbscrews 17, which requires the block 16 to be removed from the bar 14 for non-use, repair or replacement and then relocated for use.

The bracket of the invention does not suffer from the problems of previous brackets and provides many advantages.

SUMMARY OF THE INVENTION

In accordance with the invention a glue head mounting bracket for glue applying folding machines is disclosed, which includes a two piece bracket having fixed and dismountable pieces, which carry glue heads for applying glue to sheets of paper to be folded. The dismountable bracket piece carries the glue head and is capable of swiveling out of the way for non-use or removal for cleaning, repair or replacement without changing the location of the fixed bracket piece.

The principal object of the invention is to provide a glue head mounting bracket for glue applying folding machines which permits the glue head to be removed from use and returned to use without changing the glue line application position.

A further object of the invention is to provide a bracket of the character aforesaid which can be used with a variety of folding machines.

A further object of the invention is to provide a bracket of the character aforesaid which is simple to use and has a long service life.

A further object of the invention is to provide a glue head mounting bracket of the character aforesaid which can be used with a multiplicity of glue heads.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 2 is an enlarged perspective view of one of the brackets of the invention of FIG. 1;

FIG. 3 is an exploded view in perspective of the bracket of FIG. 1;

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
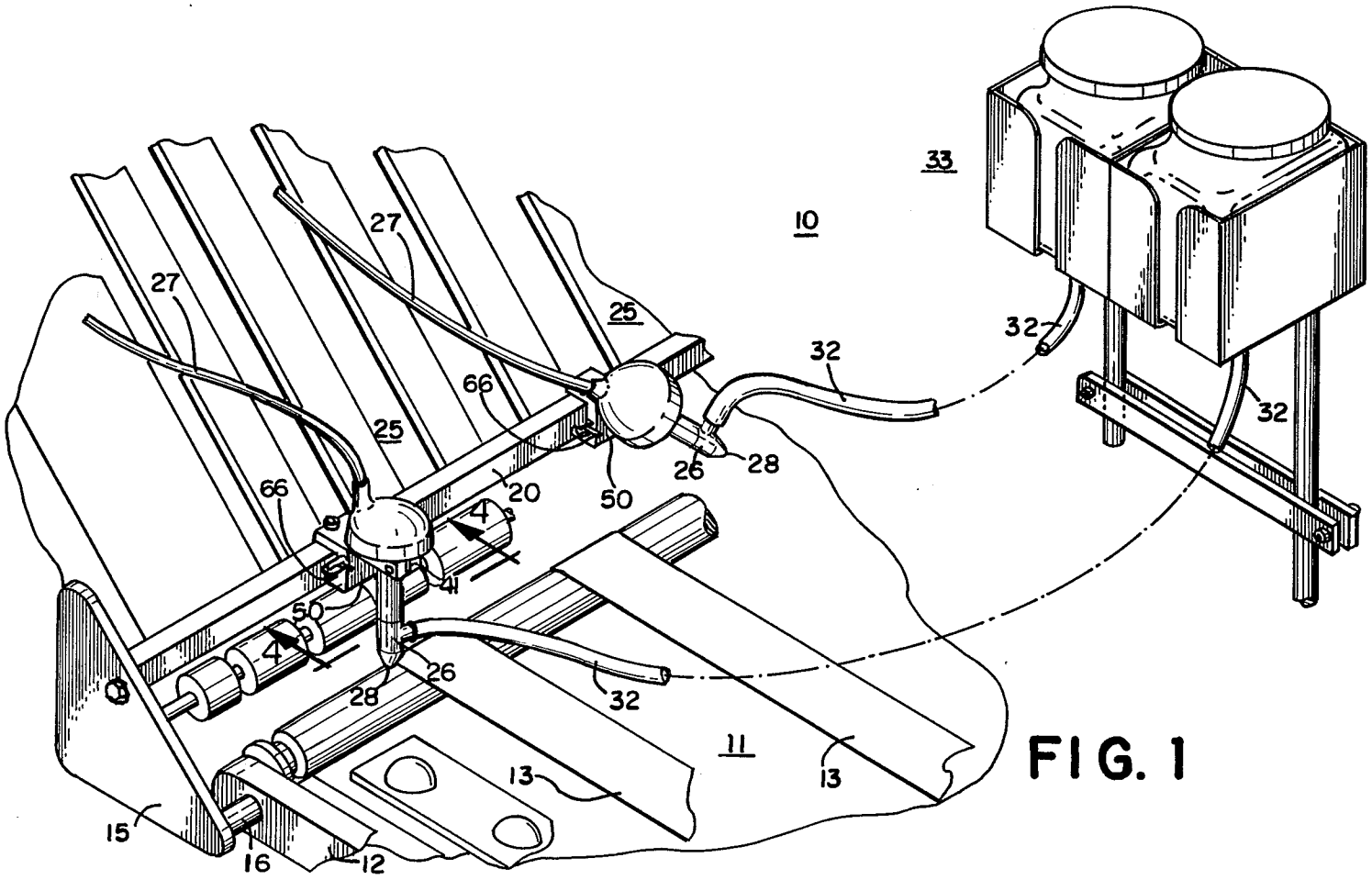
FIG. 1 is a fragmentary perspective view of a glue applying folding machine incorporating the bracket of the invention.
Figure 4:
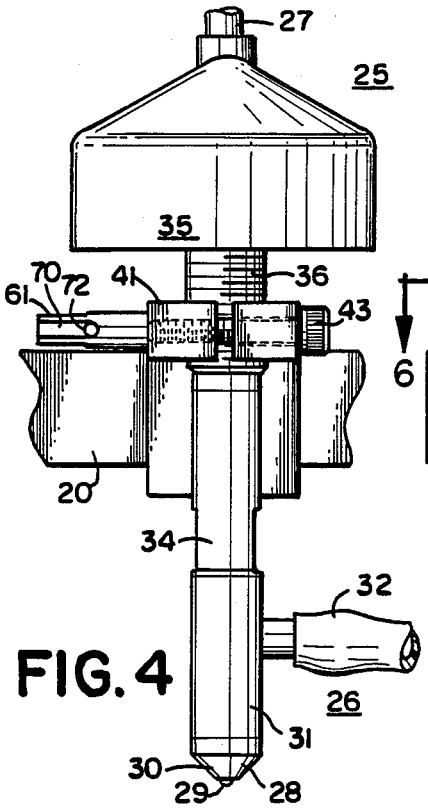
FIG. 4 is a fragmentary vertical sectional view, enlarged, taken approximately on the line 4—4 of FIG. 1.
Figure 5:
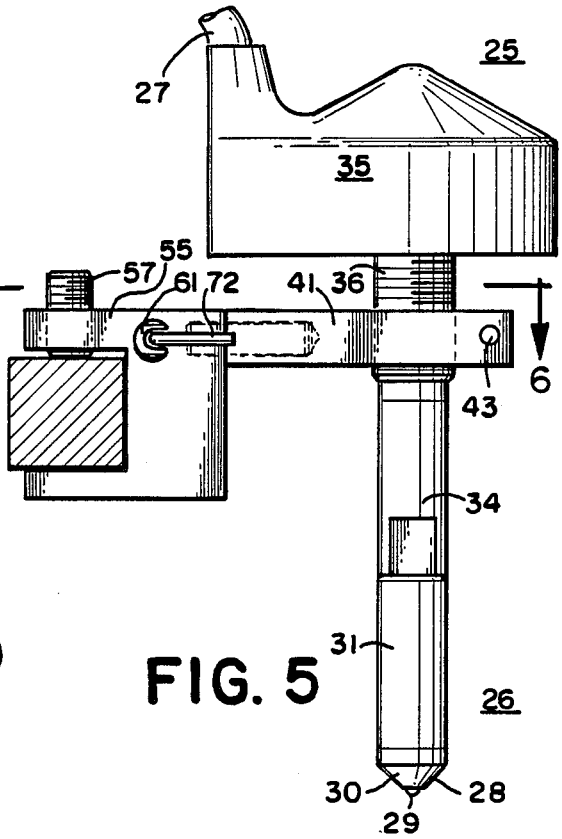
FIG. 5 is a side elevational view of the bracket of FIG. 2.
Figure 7:
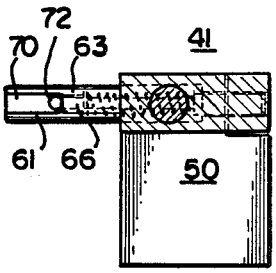
FIG. 7 is a vertical sectional view taken approximately on the line 7—7 of FIG. 6.
Figure 6:
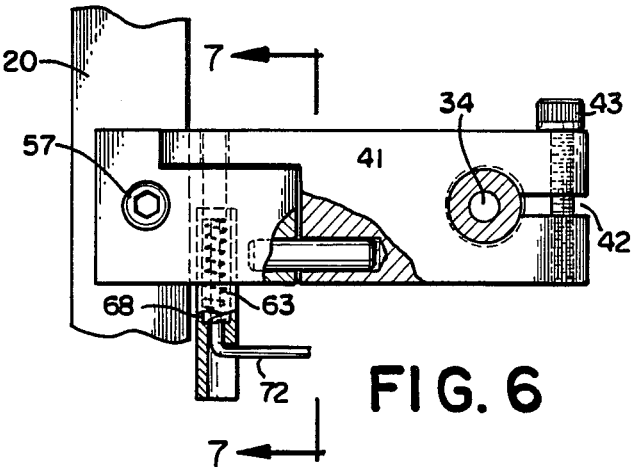
FIG. 6 is a fragmentary horizontal sectional view taken approximately on the line 6—6 of FIG. 5.

Referring now more particularly to the drawings, a portion of a typical folding machine 10 is illustrated in FIG. 1. The machine 10 includes a bed 11, with side rail 12, longitudinal members 13, and belts 14 extending along members 13 and bed 11 to transport sheets of paper (not shown) for glue application and subsequent folding.

The machine 10 also includes side plate 15 which is mounted to rail 12 by a shaft 16. The side plate 15 has a transversely extending bar 20 secured thereto by bolt 21. The bar 20 extends substantially across the width of the machine 10, and has a plurality of glue head mounting bracket assemblies 25 mounted thereon. The bracket assemblies 25 carry glue dispensing heads 26 of well known type and available from Pafra.

The heads 26 are of the solenoid operated type, with control cables 27, which extend to a control box (not shown) for initiating the flow of glue from an application nozzle 28 onto sheets of paper (not shown) which are to be glued and folded. The nozzle 28 can include a ball 29 in a tip 30 for glue dispensing, which tip includes a hollow tube 31, which has a hose 32 attached thereto, and extends to a glue reservoir 33. The tube 31 is carried on a shaft 34 and movable vertically thereon for ball 29 engagement with the paper (not shown) to be glued, by well known action of a solenoid 35 to which the control cables 27 are attached.

The heads 26 have an outer housing 36 to which the solenoids 35 and shafts 34 are fastened, the housing 36 is engaged in an opening 40 in a bracket plate 41, which is part of the bracket assembly 25.

The bracket plate 41 is of generally rectangular configuration and includes a gap 42 in plate 41, which extends perpendicularly forwardly from opening 40, with a cap screw 43 thereacross to permit closing the gap 42, to grip and retain housing 36 in opening 40. The plate 41 has a bore 45 engaged with a shaft 46, which extends from a bracket block 50, which is also a part of assembly 25. The plate 41 has a rear leg portion 51 which extends towards and along a cut out 51 of block 50 as seen in FIG. 2.

The bracket block 50 is of overall square configuration with a U-shaped cut out portion 53, which has top and bottom plates 55 and 56 which extend over and engage the transverse bar 20. The top plate 55 has a threaded opening 55' with a set screw 57 therein, which can engage bar 20 and retain block 50 at a fixed location. The block 50 has a hollow threaded bore 60 extending transversely thereacross, with a hollow sleeve 61 having external threads 62 engaged therewith. The sleeve 61 has a bore 63 with a locking plug 64 therein, which can be engaged in an opening 65 in leg 51 of plate 41. The plug 64 is attached to a lock shaft 66 with a spring 67 on shaft 66 engaged with plug 64 and shoulder 68 in bore 63, the spring normally urging the shaft 66 and plug 64 into engagement with opening 65 of leg 51.

The sleeve 61 has a portion 70 outside of block 50 with a slot 71 and the lock shaft 66 has an L-shaped portion 72 carried in slot 71.

The mode of operation will now be pointed out.

In use the location of the assemblies 25 is determined and the set screws 57 in blocks 50 are tightened to retain the assemblies on bar 20. Paper sheets (not shown) to be glued and folded are placed in the machine 10 and pass under assemblies 25, and at the desired predetermined time the solenoids 35 are activated and cause the tips 30 to move balls 29 down into contact with the paper sheets (not shown), onto which a glue line is applied, after which the tips 30 move upwardly to an out of contact position.

Should it be desired to move the tips 30 to a position for cleaning, shaft 66 is moved out along slot 71 with plug 64 being withdrawn from opening 65, so that plate 41 can be rotated on shaft 46 and tip 30 cleaned, or plate 41 and heads 25 removed for repair or other action without removing block 50, and thereby not changing the glue line location.

If desired a plurality of blocks 50 could be located on bar 20 at selected locations and glue heads 26 attached thereto as described above.

It will thus be seen that apparatus has been described with which the objects of the invention are achieved.

I claim:

1. A glue head mounting bracket for paper folding machines that have at least one glue dispensing means mounted to a transverse bar on the machine and designed to dispense a line of glue onto a sheet of paper prior to folding the improvement wherein said glue dispensing means includes a multi-piece glue head bracket assembly secured to said bar, said assembly including a bracket block normally mounted in a selected location along said bar, a bracket plate rotatably and pivotally engaged with said bracket block, a glue dispensing head carried by said bracket plate, locking means to retain said bracket plate to said bracket block, said bracket block has top and bottom plates engaged with said bar, said top plate has a set screw in selected gripping engagement with said bar to retain said bracket block at a selected location on said bar, said bracket block has a shaft extending therefrom, said bracket plate has a bore to receive said shaft and provide pivoted movement thereabout, and said locking means includes a locking plug carried in said bracket and resiliently urged into engagement with said bracket plate.

2. A glue head mounting bracket as defined in claim 1 in which said bracket plate has an opening, said glue head dispensing head includes a housing carried in said opening, and means for causing said opening to constrict and grip said housing.

* * * * *